United States Patent [19]

Cao et al.

[11] Patent Number: 4,931,195

[45] Date of Patent: Jun. 5, 1990

[54] LOW VISCOSITY STABLE NON-AQUEOUS SUSPENSION CONTAINING ORGANOPHILIC CLAY AND LOW DENSITY FILLER

[75] Inventors: Hoai-Chau Cao, Liege; Marie-Christine Houben, Alleur, both of Belgium

[73] Assignee: Colgate-Palmolive Company, New York, N.Y.

[21] Appl. No.: 324,996

[22] Filed: Mar. 17, 1989

Related U.S. Application Data

[63] Continuation of Ser. No. 102926, Sep. 30, 1987, abandoned, which is a continuation-in-part of Ser. No. 73551, Jul. 15, 1987, Pat. No. 4,828,723.

[51] Int. Cl.[5] ..... D06M 11/00; C11D 1/66; C11D 1/72; C11D 3/066

[52] U.S. Cl. ..... 252/8.8; 252/8.6; 252/8.9; 252/140; 252/155; 252/174.16; 252/174.21; 252/174.25; 252/526; 252/528; 252/547; 252/545; 252/DIG. 14

[58] Field of Search ..... 252/8.8, 174.21, DIG. 1, 252/DIG. 14, 174.25, 135, 140, 165, 171, 547

[56] References Cited

U.S. PATENT DOCUMENTS

| | | | |
|---|---|---|---|
| 3,985,668 | 10/1976 | Hartman | 252/99 |
| 4,226,736 | 10/1980 | Bush et al. | 252/135 |
| 4,247,424 | 1/1981 | Kuzel | 252/528 |
| 4,264,466 | 4/1981 | Carleton et al. | 252/99 |
| 4,405,483 | 9/1983 | Kuzel | 252/140 |
| 4,510,070 | 4/1985 | Tsutsumi et al. | 252/351 |
| 4,536,315 | 8/1985 | Ramachandran et al. | 252/174.11 |
| 4,595,623 | 6/1986 | DuPont et al. | 428/195 |
| 4,618,446 | 10/1986 | Haslop et al. | 252/135 |
| 4,661,280 | 4/1987 | Ouhadi et al. | 252/99 |

FOREIGN PATENT DOCUMENTS

| | | |
|---|---|---|
| 0266199 | 5/1988 | European Pat. Off. . |
| 2017072 | 10/1979 | United Kingdom . |
| 2168377 | 6/1986 | United Kingdom . |

*Primary Examiner*—Dennis Albrecht
*Assistant Examiner*—James M. Silbermann
*Attorney, Agent, or Firm*—N. Blumenkopf; R. C. Sullivan; M. M. Grill

[57] ABSTRACT

Lecithin or certain other phosphate esters are added to a non-aqueous liquid heavy duty laundry detergent composition in the form of a suspension of builder salt in liquid nonionic surfactant containing small amounts of low density filler, such as hollow plastic or glass microspheres to provide stabilization against phase separation and further containing a small amount of organophilic modified clay, such as a water-swellable smectite clay, in which the metal cations are totally or partially exchanged with mono- or di-long chain quaternary ammonium compound to provide a viscoelastic network structure. The lecithin reduces plastic viscosity and helps maintain the viscoelastic network structure over extended periods of time.

25 Claims, No Drawings

LOW VISCOSITY STABLE NON-AQUEOUS SUSPENSION CONTAINING ORGANOPHILIC CLAY AND LOW DENSITY FILLER

This is a continuation of application Ser. No. 07/102,926 filed Sept. 30, 1987, now abandoned, which is in turn a continuation-in-part of prior copending, commonly assigned application Ser. No. 073,551, filed July 15, 1987, the disclosure of which are incorporated herein by reference thereto.

BACKGROUND OF THE INVENTION (1) Field of Invention

This invention relates to stabilized non-aqueous liquid suspensions, especially non-aqueous liquid fabric-treating compositions. More particularly, this invention relates to non-aqueous liquid laundry detergent compositions which are made stable against phase separation even at relatively low viscosity, and even more particularly which remain stable under both static and dynamic conditions and are easily pourable, to the method of preparing these compositions and to the use of these compositions for cleaning soiled fabrics.

(2) Discussion of Prior Art

Liquid non-aqueous heavy duty laundry detergent compositions are well known in the art. For instance, compositions of that type may comprise a liquid non-ionic surfactant in which are dispersed particles of a builder, as shown, for instance, in U.S. Pat. Nos. 4,316,812; 3,630,929; 4,254,466; and 4,661,280.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are non-dusting, and they usually occupy less storage space. Additionally, the liquid detergents may have incorporated in their formulations materials which could not stand drying operations without deterioration, which materials are often desirably employed in the manufacture of particulate detergent products.

Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

The present inventors have been extensively involved as part of an overall corporate research effort in studying the rheological behavior of nonionic liquid surfactant systems with particulate matter suspended therein. Of particular interest has been non-aqueous built laundry liquid detergent compositions and the problems of phase separation and settling of the suspended builder and other laundry additives. These considerations have an impact on, for example, product pourability, dispersibility and stability.

It is known that one of the major problems with built liquid laundry detergents is their physical stability. This problem stems from the fact that the density of the solid suspended particles is higher than the density of the liquid matrix. Therefore, the particles tend to sediment according to Stoke's law. In fact, the non-aqueous liquid suspensions of the detergent builder particles, such as the polyphosphate builders, especially sodium tripolyphosphate (TPP) in nonionic surfactant are found to behave, rheologically, substantially according to the Casson equation:

$$\sigma^{\frac{1}{2}} = \sigma_o^{\frac{1}{2}} + \eta\infty^{\frac{1}{2}}\gamma\kappa$$

where $\gamma$ is the shear rate;

$\sigma$ is the shear stress;

$\sigma_o$ is the yield stress (or yield value); and $\eta\infty$ is the "plastic viscosity" (apparent viscosity at infinite shear rate).

The yield stress is the minimum stress necessary to induce a plastic deformation (flow) of the suspension. Once the yield stress is overcome, the network of suspended particles breaks at some points and the sample begins to flow, but with a very high apparent viscosity. If the shear stress is much higher than the yield stress, the particles are partially shear-deflocculated and the apparent viscosity decreases. Finally, if the shear stress is much higher than the yield stress value, the particles are completely shear-deflocculated and the apparent viscosity is very low, as if no particle interaction were present.

Therefore, the higher the yield stress of the suspension, the higher the apparent viscosity at low shear rate and the better is the physical stability of the product.

Two basic solutions exist to solve the sedimentation problem: increasing liquid matrix viscosity and reducing solid particle size.

Grinding to reduce the particle size as a means to increase product stability provides the following advantages:

1. The particle specific surface area is increased, and, therefore, particle wetting by the non-aqueous vehicle (liquid non-ionic) is proportionately improved.

2. The average distance between pigment particles is reduced with a proportionate increase in particle-to-particle interaction. Each of these effects contributes to increase the rest-gel strength and the suspension yield stress while at the same time, grinding significantly reduces plastic viscosity.

The above-mentioned U.S. Pat. No. 4,316,812 discloses the benefits of grinding solid particles, e.g., builder and bleach, to an average particle diameter of less than 10 microns. However, it has been found that merely grinding to such small particle sizes does not, by itself, impart sufficient long term stability against phase separation.

For instance, it is known that such suspensions can be stabilized against settling by adding inorganic or organic thickening agents or dispersants, such as, for example, very high surface area inorganic materials, e.g. finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperature. Furthermore, these additives do not contribute to the cleaning performance of the formulation. U.S. Pat. No. 4,661,280 to T. Ouhadi, et al. discloses the use of aluminum stearate for increasing stability of suspensions of builder salts in liquid nonionic surfactant. The addition of small amounts of aluminum stearate increases yield stress without increasing plastic viscosity.

According to U.S. Pat. No. 3,985,668 to W. L. Hartman, an aqueous false body fluid abrasive scouring composition is prepared from an aqueous liquid and an appropriate colloid-forming material, such as clay or other inorganic or organic thickening or suspending agent, especially smectite clays, and a relatively light, water-insoluble particulate filler material, which, like the abrasive material, is suspended throughout the false body fluid phase. The lightweight filler has particle size diameters ranging from 1 to 250 microns and a specific gravity less than that of the false body fluid phase. It is suggested by Hartman that inclusion of the relatively light, insoluble filler in the false body fluid phase helps to minimize phase separation, i.e. minimize formation of a clear liquid layer above the false body abrasive composition, first, by virtue of its buoyancy exerting an upward force on the structure of the colloid-forming agent in the false body phase counteracting the tendency of the heavy abrasive to compress the false body structure and squeeze out liquid. Second, the filler material acts as a bulking agent replacing a portion of the water which would normally be used in the absence of the filler material, thereby resulting in less aqueous liquid available to cause clear layer formation and separation.

British application No. GB 2,168,377A, published June 18, 1986, discloses aqueous liquid dishwashing detergent compositions with abrasive, colloidal clay thickener and low density particulate filler having particle sizes ranging from about 1 to about 250 microns and densities ranging from about 0.01 to about 0.5 g/cc, used at a level of from about 0.07% to about 1% by weight of the composition. It is suggested that the filler material improves stability by lowering the specific gravity of the clay mass so that it floats in the liquid phase of the composition. The type and amount of filler is selected such that the specific gravity of the final composition is adjusted to match that of the clear fluid (i.e. the composition without clay or abrasive materials). The low density particulate fillers disclosed on page 4, lines 33–35, of the British application can also be used as the low density filler in the compositions of the present invention. According to this patent the filler material improves stability by lowering the specific gravity of the clay mass so that it floats in the aqueous liquid phase. The type and amount of filler material is selected such that the specific gravity of the final composition is adjusted to match that of the clear fluid (without clay and abrasive).

It is also known to include an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials as disclosed in U.S. Pat. No. 3,630,929.

It has long been known that aqueous swelling colloidal clays, such as bentonite and montmorillonite clays, can be modified by exchange of the metallic cation groups with organic groups, thereby changing the hydrophilic clays to organophilic clays. The use of such organophilic clays as gel-forming clays has been described in U.S. Pat. No. 2,531,427 to E. A. Hauser. Improvements and modifications of the organophilic gel-forming clays are described, for example, in the following U.S. Pat. Nos.: 2,966,506—Jordan; 4,105,578—Finlayson, et al.; 4,208,218—Finlayson; 4,287,086—Finlayson; 4,434,075—Mardis, et al.; 4,434,076—Mardis, et al.; all assigned to NL Industries, Inc., formerly National Lead Company. According to these NL patents, these organophilic clay gellants are useful in lubricating greases, oil based muds, oil base packer fluids, paints, paint-varnish-lacquer removers, adhesives, sealants, inks, polyester gel coats and the like. However, use as a stabilizer in a non-aqueous liquid detergent composition for laundering fabrics has not been suggested.

On the other hand, the use of clays in combination with quaternary ammonium compounds (often referred to as "QA" compounds) to impart fabric softening benefits to laundering compositions has also been described. For instance, mention can be made of the British Patent Application No. GB 2,141,152 A, published Dec. 12, 1984, to P. Ramachandran, and the many patents referred to therein of fabric softening compositions based on organophilic QA clays.

According to the aforementioned U.S. Pat. No. 4,264,466 to Carleton, et al., the physical stability of a dispersion of particulate materials, such as detergent builders, in a non-aqueous liquid phase is improved by using as a primary suspending agent an impalpable chain structure type clay, including sepiolite, attapulgite, and polygorskite clays. The patentees state and the comparative examples in this patent show that other types of clays, such as montmorillonite clay, e.g. Bentonite L, hectorite clay (e.g. Veegum T) and kaolinite clay (e.g., Hydrite PX), even when used in conjunction with an auxiliary suspension aid, including cationic surfactants, inclusive of QA compounds, are only poor suspending agents. Carleton, et al. also refer to use of other clays as suspension aids and mention, as examples, U.S. Pat. Nos. 4,049,034; 4,005,027 (both aqueous systems); 4,166,039; 3,259,574; 3,557,037; 3,549,542; and U.K. Patent Application No. 2,017,072.

Commonly assigned copending application Ser. No. 063,199, filed June 17, 1987, discloses incorporation into non-aqueous liquid fabric treating compositions of up to about 1% by weight of an organophilic water-swellable smectite clay modified with a cationic nitrogen-containing compound including at least one long chain hydrocarbon having from about 8 to about 22 carbon atoms to form an elastic network or structure throughout the suspension to increase the yield stress and increase stability of the suspension.

While the addition of the organophilic clay improves stability of the suspension, still further improvements were desired, especially for particulate suspensions having relatively low yield values for optimizing dispensing and dispersion during use.

In the commonly assigned copending application, Ser. No. 073,653, filed on July 15, 1987, and entitled "STABLE NON-AQUEOUS CLEANING COMPOSITION CONTAINING LOW DENSITY FILLER AND METHOD OF USE" the use of low density filler material for stabilizing against phase separation of liquid suspensions of finely divided solid particulate matter in a liquid phase by equalizing the densities of the dispersed particle phase and the liquid phase is disclosed. These modified liquid suspensions exhibit excellent phase stabilization when left to stand for extended periods of time up to 6 months or longer or even when subjected to moderate shaking. However, it was recently observed that when the low-density filler modified suspensions are subjected to strong vibrations, such as may be encountered during transportation by rail, truck, etc., the homogeneity of the dispersion is degraded as a portion of the low density filler migrates to the upper surface of the liquid suspension.

Therefore, still further improvements were desired in the stability of non-aqueous liquid fabric treating compositions. This desire was accomplished based on the present inventors' discovery that by adding a small amount, up to about 1% by weight, of an organophilic clay to a liquid suspension of finely divided functionally active suspended particles, containing a small amount of low density filler, the filler and other functional suspended particles interacting in such a manner as to provide, in essence, a suspension of composite particles having a density of substantially the same value as the density of the continuous liquid phase, a stronger network structure is provided and is thereby effective to inhibit the tendency of the suspended functional particles, e.g. detergent builder, bleaching agent, antistatic agent, etc., to settle and conversely, to inhibit rising of the low density filler or formation of a clear liquid phase, when the composition is subjected to strong vibrational forces. Accordingly, there is disclosed in copending commonly assigned application, Ser. No. 073,551, filed July 15, 1987, a liquid cleaning composition composed of a suspension of functionally active particles in a liquid nonionic surfactant wherein the composition includes an amount of low density filler to increase the stability of the suspension while at rest and when shaken and an amount of organophilic clay to improve stability of the composition when subjected to strong vibrational forces.

However, although the stability of the non-aqueous suspension is significantly improved by the low-density filler/organophilic clay stabilizing system, certain disadvantages have become apparent. First, it has been observed that, with passage of time, the viscoelastic structure imparted by the organophilic clay weakens, such weakening being manifested by a steady decrease in yield value. Consequently, there can come a point in time within the anticipated shelf life of the product at which the yield value will drop below a level required to maintain the stability of the low density filler, particularly under strong vibrational forces.

A second adverse consequence of the prior stabilizing system is that the incorporation of the low density filler, such as microspheres, increases the plastic viscosity of the product and consequently decreases its flowability.

According to the present invention it has now been discovered that the problem of increased viscosity of the low density filler stabilized non-aqueous suspension and the problem of the change in yield value with time for the organophilic clay stabilized non-aqueous suspension can each be substantially overcome by incorporating into the organophilic clay and/or low density filler stabilized liquid cleaning composition a small, but effective amount of certain phosphate esters. The addition of the phosphate ester compounds reduces the plastic viscosity of the compositions containing low density filler and stabilizes the yield value with ageing of the compositions containing organophilic clay.

Accordingly, it is an object of the invention to provide liquid fabric treating compositions which are suspensions of insoluble fabric-treating particles in a non-aqueous liquid and which are storage stable over time, easily pourable and dispersible in cold, warm or hot water.

It is also an object of this invention to provide viscoelastic, non-aqueous suspensions of insoluble fabric-treating particles which can maintain their rheological properties over time, even when subjected to strong vibrational forces.

Another object of this invention is to formulate highly built heavy duty non-aqueous liquid nonionic surfactant laundry detergent compositions which resist settling of the suspended solid particles or separation of the liquid phase and which are readily flowable.

A specific object of this invention is to provide a stable heavy duty built non-aqueous liquid nonionic laundry detergent composition which includes a non-aqueous liquid composed of a nonionic surfactant, fabric-treating solid particles suspended in the non-aqueous liquid, at least one of a low density filler in an amount up to about 10% by weight to substantially equalize the density of the continuous liquid phase and the density of the suspended particulate phase—inclusive of the low density filler and other suspended particles, such as builder particles, and an organophilic modified clay in an amount, up to about 1% by weight, to prevent loss of product homogeneity even when the composition is subjected to strong vibrational forces, and an amount of lecithin or glycol phosphate, polyglycol phosphate or glycerophosphate ester effective to reduce the plastic viscosity and stabilize the yield value of the composition.

A more specific object of the invention is to provide a method for improving the stability and reducing the viscosity of a non-aqueous suspension of functionally active solid particles stabilized with low density filler and organophilic clay.

According to another aspect, the invention provides a method for cleaning soiled fabrics by contacting the soiled fabrics with the liquid non-ionic laundry detergent composition as described above.

According to still another aspect of the invention, a method is provided for stabilizing a suspension of a first finely divided functionally active particulate solid substance in a continuous liquid vehicle phase, the suspended solid particles having a density greater than the density of the liquid phase, which method involves adding to the suspension of solid particles an amount of a finely divided filler having a density lower than the density of the liquid phase such that the density of the dispersed solid particles together with the filler becomes similar to the density of the liquid phase, said filler also increasing plastic viscosity of the suspension, a small amount of an organophilic clay to enhance the structural cohesiveness of the suspension and overcome the tendency of the filler to rise to the surface of the composition when the composition is subjected to strong vibrational forces, such as during shipping, and a small amount of lecithin, glycol phosphate ester, polyglycol phosphate ester or glycerophosphate ester to effectively reduce the plastic viscosity of the suspension and maintain its structural adhesiveness.

The viscosity reducing, yield value stabilizing phosphate ester compound used in the present invention is preferably lecithin. Pure lecithin is a fatty acid substituted phosphatidylcholine having the general structural formula:

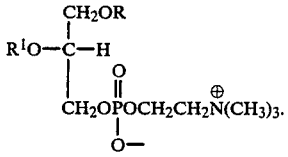

In practice, however, lecithin is rarely available in pure form and generally speaking, lecithin refers to a complex, naturally occurring mixture of phosphatides, triglycerides, carbohydrates, sterols and other minor ingredients.

Lecithin is generally obtained from vegetable oil with soybean oil being the principal source. Other sources of lecithin include egg yolk, milk and animal brains. The phosphatides that are present in lecithin are similar except that their proportions vary. Similarly, the other minor constituents of lecithin vary according to the particular source.

Typical fatty acid profiles of commercially available lecithin are shown in the following table:

Comparative Fatty Acid Profiles (% by weight)

| Number of carbons and double bonds | Soybean | Commercial Lecithin | Oil-Free Commercial Lecithin |
|---|---|---|---|
| saturated | | | |
| $C_{16:0}$ | 9 | 15 | 19 |
| $C_{18:0}$ | 5 | 5 | 5 |
| Total | 14 | 20 | 24 |
| unsaturated | | | |
| $C_{18:1}$ | 26 | 17 | 10 |
| $C_{18:2}$ | 53 | 55 | 59 |
| $C_{18:3}$ | 7 | 8 | 7 |
| Total | 86 | 80 | 76 |

A typical composition of soybean lecithin, the most common commercial product, is as follows:

| | % |
|---|---|
| Phosphatidyl choline (I) | 20 |
| Phosphatidyl ethanolamine (II) | 15 |
| Phosphatidyl inositide (III) | 20 |
| Phosphatic acids and other phosphatides | 5 |
| Carbohydrates, sterols | 5 |
| Triglycerides with | 35 |

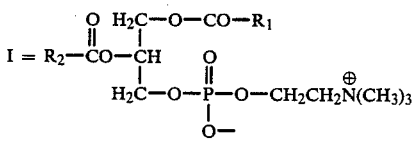

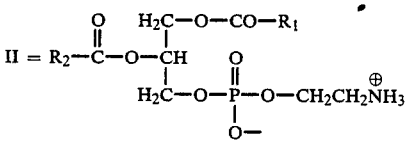

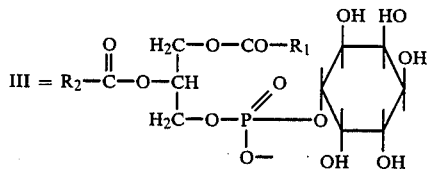

-continued

| | % |
|---|---|
| $R_1$, $R_2$ = $C_{16:0}$, $C_{18:0}$, $C_{18:1}$, $C_{18:2}$, $C_{18:3}$. | |

Any of these naturally occurring forms of lecithin can be used in the present invention. Furthermore, the lecithin need not be pure and any of the commercially available grades of lecithin which are generally mixtures of phosphatidylcholine, phosphatidylethanolamine, phosphatidylinositol (phosphatides) and triglycerides, regardless of the source, e.g. egg yolk, soya beans, etc., can be used as the viscosity-reducing, stabilizer. However, it is generally preferred to use a double bleached form of lecithin to minimize any base odors which may be present in the natural products.

Other useful phosphate ester compounds include phosphate esters of glycols, polyglycols, and glycerols. As the glycols, mention may be made, for example, of ethylene glycol, propylene glycol, butylene glycol, and glycol ethers, such as diethylene glycol monomethyl ether, diethylene glycol monoethyl ether, and the like. The polyglycols may have up to about 20 repeating oxyethylene or oxypropylene units, preferably up to about 10 oxyethylene units. As the glycerol compounds mention can be made not only of glycerol but also of alkyl or alkenyl substituted glycerols, for example, glycerols with up to about 20 carbon atoms, preferably up to about 10 carbon atoms, such as 1,2,3-butane triol, 1,2,3-pentane triol, 1,2,3-decane triol, 1,2,3-hex-2-ene triol, and the like. The non-phosphated hydroxyl group of the glycol compound and at least one of the non-phosphated hydroxyl groups of the glycerol compounds are esterified with a long chain fatty acid.

Suitable phosphate ester compounds, inclusive of the preferred active phosphatidylcholine of lecithin can be represented by the following general formula (I) or (II):

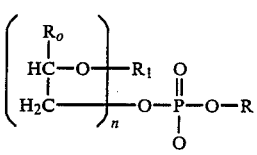

(I)

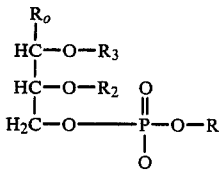

(II)

where

R represents a linear or branched alkyl or alkenyl group having from 1 to 8 carbon atoms and which may be substituted by an amino group of formula $-NR_4R_5$, where $R_4$ and $R_5$ are independently, hydrogen or alkyl of 1 to 4 carbon atoms, or by a quaternized nitrogen of formula $-NR_4R_5R_6$, where $R_4$ and $R_5$ are defined above and $R_6$ is hydrogen or alkyl of 1 to 4 carbon atoms;

$R_0$ is hydrogen or lower alkyl or lower alkenyl;

$R_1$ is an acyl residue of a long chain fatty acid;

$R_2$ is hydrogen or an acyl residue of a long chain fatty acid;

$R_3$ is hydrogen or an acyl residue of a long chain fatty acid; with the proviso that $R_2$ and $R_3$ are not both hydrogen at the same time; and, n is a number of from 1 to 10.

As used herein the term "lower alkyl" or "lower alkenyl" includes alkyl or alkenyl with from 1 to 5, preferably 1 to 4, carbon atoms, such as methyl, ethyl, propyl, butyl, isobutyl, propenyl, and the like. The term "long chain fatty acid" refers to saturated or unsaturated fatty carboxylic acids having from about 8 to about 22 carbon atoms, preferably 10 to 18 carbons, especially 12 to 18 carbon atoms, including mixtures of such fatty acids. The acyl residue of the fatty acid will have the formula $$-\underset{\underset{O}{\|}}{C}-R.$$

The preferred phosphate ester compounds have structures similar to that of lecithin, particularly phosphatidyl choline, namely the alkylamine, alkenylamine, alkylammonium or alkenylammonium phosphate ester of a glycol, polyglycol or glycerol having at least one long chain fatty carboxylic acid ester group in the molecule.

The viscosity-reducing, stabilizing additive is used in an amount effective to lower the plastic viscosity of the composition to less than about 800 mPa.s (800 centipoise), preferably less than about 600 mPa.s, such as about 400 mPa.s. Generally, amounts of from about 0.1 to 3% by weight, based on the total composition will provide viscosities within the desired range.

In the preferred embodiment of special interest herein the liquid phase of the composition of this invention is comprised predominantly or totally of liquid nonionic synthetic organic detergent. A portion of the liquid phase may be composed, however, of organic solvents which may enter the composition as solvent vehicles or carriers for one or more of the solid particulate ingredients, such as in enzyme slurries, perfumes, and the like. Also as will be described in detail below, organic solvents, such as alcohols and ethers, may be added as viscosity control and anti-gelling agents.

The nonionic synthetic organic detergents employed in the practice of the invention may be any of a wide variety of such compounds, which are well known and, for example, are described at length in the text *Surface Active Agents,* Vol. II, by Schwartz, Perry and Berch, published in 1958 by Interscience Publishers, and in McCutcheon's *Detergents and Emulsifiers,* 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 10 to 22 carbon atoms and wherein the number of mols of lower alkylene oxide (of 2 or 3 carbon atoms) is from 3 to 20. Of such materials it is preferred to employ those wherein the higher alkanol is a higher fatty alcohol of 10 to 11 or 12 to 15 carbon atoms and which contain from 5 to 18, preferably 6 to 14 lower alkoxy groups per mol. The lower alkoxy is often just ethoxy but in some instances, it may be desirably mixed with propoxy, the latter, if present, often being a minor (less than 50%) proportion. Exemplary of such compounds are those wherein the alkanol is of 12 to 15 carbon atoms and which contain about 7 ethylene oxide groups per mol, e.g., Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company. Another preferred class of useful nonionics are represented by the commercially well known class of nonionics which are the reaction product of a higher linear alcohol and a mixture of ethylene and propylene oxides, containing a mixed chain of ethylene oxide and propylene oxide, terminated by a hydroxyl group. Examples include the nonionics sold under the Plurafac trademark of BASF, such as Plurafac RA30, Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide), Plurafac B26, and Plurafac RA50 (a mixture of equal parts Plurafac D25 and Plurafac RA40).

Generally, the mixed ethylene oxide-propylene oxide fatty alcohol condensation products represented by the general formula $$RO(C_3H_6O)_p(C_2H_4O)_qH,$$

wherein R is a straight or branched primary or secondary aliphatic hydrocarbon, preferably alkyl or alkenyl, especially preferably alkyl, of from 6 to 20, preferably 10 to 18, especially preferably 12 to 18 carbon atoms, p is a number of from 2 to 8, preferably 3 to 6, and q is a number of from 2 to 12, preferably 4 to 10, can be advantageously used where low foaming characteristics are desired. In addition, these surfactants have the advantage of low gelling temperatures.

Another group of liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 25-7 is an ethoxylated $C_{12}$–$C_{15}$ fatty alcohol with an average of 7 moles ethylene oxide; etc.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, such as 40 to 60% thereof and the nonionic detergent will often contain at least 50% of such preferred poly-lower alkoxy higher alkanol.

Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the alkoxy chain, if such branched alkyl is not more than three carbons in length. Normally, the proportion of carbon atoms in such a branched configuration will be minor rarely exceeding 20% of the total carbon atom content of the alkyl. Similarly although linear alkyls which are terminally joined to the alkylene oxide chains are highly preferred and are considered to result in the best combination of detergency, biodegradability and non-gelling characteristics, medial or secondary joinder to the alkylene oxide in the chain may occur. It is usually in only a minor proportion of such alkyls, generally less than 20% but, as is the case of the mentioned Tergitols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of viscosity and gel controlling compounds can also improve the properties of the detergents based on such nonionics. In some cases, as when a higher molecular weight poly-lower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures.

In view of their low gelling temperatures and low pour points, another preferred class of nonionic surfactants includes the $C_{12}$–$C_{13}$ secondary fatty alcohols with relatively narrow contents of ethylene oxide in the range of from about 7 to 9 moles, especially about 8 moles ethylene oxide per molecule and the $C_9$ to $C_{11}$, especially $C_{10}$ fatty alcohols ethoxylated with about 6 moles ethylene oxide.

Furthermore, in the compositions of this invention, it may be advantageous to include an organic solvent or diluent which can function as a viscosity control and gel-inhibiting agent for the liquid nonionic surface active agents. Lower ($C_1$–$C_6$) aliphatic alcohols and glycols, such as ethanol, isopropanol, ethylene glycol, hexylene glycol and the like have been used for this purpose. Polyethylene glycols, such as PEG 400, are also useful diluents. Alkylene glycol ethers, such as the compounds sold under the trademarks, Carbopol and Carbitol which have relatively short hydrocarbon chain lengths ($C_2$–$C_8$) and a low content of ethylene oxide (about 2 to 6 EO units per molecule) are especially useful viscosity control and anti-gelling solvents in the compositions of this invention. This use of the alkylene glycol ethers is disclosed in the commonly assigned copending application Ser. No. 687,815, filed December 31, 1984, to T. Ouhadi, et al. the disclosure of which is incorporated herein by reference. Suitable glycol ethers can be represented by the following general formula $$RO(CH_2CH_2O)_nH$$

where R is a $C_2$–$C_8$, preferably $C_2$–$C_5$ alkyl group, and n is a number of from about 1 to 6, preferably 1 to 4, on average.

Specific examples of suitable solvents include ethylene glycol monoethyl ether ($C_2H_5$—O—$CH_2CH_2OH$), diethylene glycol monobutyl ether ($C_4H_9$—O—$(CH_2CH_2O)_2H$), tetraethylene glycol monooctyl ether ($C_8H_{17}$—O—$(CH_2CH_2O)_4H$), etc. Diethylene glycol monobutyl ether is especially preferred.

Another useful antigelling agent which can be included as a minor component of the liquid phase, is an aliphatic linear or aliphatic monocyclic dicarboxylic acid, such as the $C_6$ to $C_{12}$ alkyl and alkenyl derivatives of succinic acid or maleic acid, and the corresponding anhydrides or an aliphatic monocyclic dicarboxylic acid compound. The use of these compounds as antigelling agents in non-aqueous liquid heavy duty built laundry cally unsaturated and the aliphatic linear portion may be straight of branched. The aliphatic monocylic molecules may be saturated or may include a single double bond in the ring. Furthermore, the aliphatic hydrocarbon ring may have 5- or 6-carbon atoms in the ring, i.e. cyclopentyl, cyclopentenyl, cyclohexyl, or cyclohexenyl, with one carboxyl group bonded directly to a carbon atom in the ring and the other carboxyl group bonded to the ring through a linear alkyl or alkenyl group.

The aliphatic linear dicarboxylic acids have at least about 6 carbon atoms in the aliphatic moiety and may be alkyl or alkenyl having up to about 14 carbon atoms, with a preferred range being from about 8 to 13 carbon atoms, especially preferably 9 to 12 carbon atoms. One of the carboxylic acid groups (—COOH) is preferably bonded to the terminal (alpha) carbon atom of the aliphatic chain and the other carboxyl group is preferably bonded to the next adjacent (beta) carbon atom or it may be spaced two or three carbon atoms from the o-position, i.e. on the $\gamma$- or $\Delta$- carbon atoms. The preferred aliphatic dicarboxylic acids are the, $\alpha,\beta$-dicarboxylic acids and the corresponding anhydrides, and especially preferred are derivatives of succinic acid or maleic acid and have the general formula:

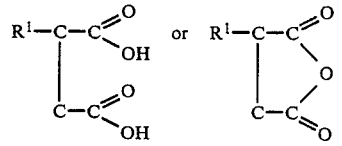

wherein $R^1$ is an alkyl or alkenyl group of from about 6 to 12 carbon atoms, preferably 7 to 11 carbon atoms, especially preferably 8 to 10 carbon atoms.

The alkyl or alkenyl group may be straight or branched. The straight chain alkenyl groups are especially preferred. It is not necessary that $R^1$ represent a single alkyl or alkenyl group and mixtures of different carbon chain lengths may be present depending on the starting materials for preparing the dicarboxylic acid.

The aliphatic monocyclic dicarboxylic acid may be either 5- or 6-membered carbon rings with one or two linear aliphatic groups bonded to ring carbon atoms. The linear aliphatic groups should have at least about 6, preferably at least about 8, especially preferably at least about 10 carbon atoms, in total, and up to about 22, preferably up to about 18, especially preferably up to about 15 carbon atoms. When two aliphatic carbon atoms are present attached to the aliphatic ring they are preferably located para- to each other. Thus, the preferred aliphatic cyclic dicarboxylic acid compounds may be represented by the following structural formula

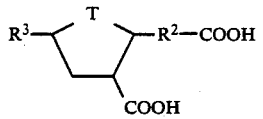

where

—T— represents —$CH_2$—, —CH=, —$CH_2$—$CH_2$— or —CH=CH—;

$R^2$ represents an alkyl or alkenyl group of from 3 to 12 carbon atoms; and $R^3$ represents a hydrogen atom or an alkyl or alkenyl group of from 1 to 12 carbon atoms, with the proviso that the total number of carbon atoms in $R^2$ and $R^3$ is from about 6 to about 22.

Preferably —T— represents —$CH_2$—$CH_2$— or —CH=CH—, especially preferably —CH=CH—.

$R^2$ and $R^3$ are each preferably alkyl groups of from about 3 to about 10 carbon atoms, especially from about 4 to about 9 carbon atoms, with the total number of carbon atoms in $R^2$ and $R^3$ being from about 8 to about 15. The alkyl or alkenyl groups may be straight of branched but are preferably straight chains.

The amount of the nonionic surfactant is generally within the range of from about 20 to about 70%, such as about 22 to 60% for example 25%, 30%, 35% or 40% by weight of the composition. The amount of solvent or diluent when present is usually up to 20%, preferably up to 15%, for example, 0.5 to 15%, preferably 5.0 to 12%. The weight ratio of nonionic surfactant to alkylene glycol ether as the viscosity control and antigelling agent, when the latter is present, as in the preferred embodiment of the invention is in the range of from about 100:1 to 1:1, preferably from about 50:1 to about 2:1, such as 10:1, 8:1, 6:1, 4:1 or 3:1.

The amount of the dicarboxylic acid gel-inhibiting compound, when used, will be dependent on such factors as the nature of the liquid nonionic surfactant, e.g. its gelling temperature, the nature of the dicarboxylic acid, other ingredients in the composition which might influence gelling temperature, and the intended use (e.g. with hot or cold water, geographical climate, and so on). Generally, it is possible to lower the gelling temperature to no higher than about 3° C., preferably no higher than about 0° C., with amounts of dicarboxylic acid anti-gelling agent in the range of about 1% to about 30%, preferably from about 1.5% to about 15%, by weight, based on the weight of the liquid nonionic surfactant, although in any particular case the optimum amount can be readily determined by routine experimentation.

The invention detergent compositions in the preferred embodiment also include as an essential ingredient water soluble and/or water dispersible detergent builder salts. Typical suitable builders include, for example, those disclosed in the aforementioned U.S. Pat. Nos. 4,316,812, 4,264,466, 3,630,929, and many others. Water-soluble inorganic alkaline builder salts which can be used alone with the detergent compound or in admixture with other builders are alkali metal carbonates, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred where phosphate containing ingredients are not prohibited due to environmental concerns. The alkali metal silicates are useful builder salts which also function to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same ratios can also be used.

Another class of builders are the water-insoluble aluminosilicates, both of the crystalline and amorphous type. Various crystalline zeolites (i.e. aluminosilicates) are described in British Pat. No. 1,504,168, U.S. Pat. No. 4,409,136 and Canadian Pat. Nos. 1,072,835 and 1,087,477, all of which are hereby incorporated by reference for such descriptions. An example of amorphous zeolites useful herein can be found in Belgium Pat. 835,351 and this patent too is incorporated herein by reference.

The zeolites generally have the formula $$(M_2O)_x.(Al_2O_3)_y.(SiO_2)_z.WH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA) and triethanolammonium N-(2-hydroxyethyl)nitrilodiacetates. Mixed salts of these polycarboxylates are also suitable.

Other suitable builders of the organic type include carboxymethylsuccinates, tartronates and glycollates and the polyacetal carboxylates. The polyacetal carboxylates and their use in detergent compositions are described in U.S. Pat. Nos. 4,144,226; 4,315,092 and 4,146,495. Other patents on similar builders include U.S. Pat. Nos. 4,141,676; 4,169,934; 4,201,858; 4,204,852; 4,224,420; 4,225,685; 4,226,960; 4,233,422; 4,233,423; 4,302,564 and 4,303,777. Also relevant are European Patent Application Nos. 0015024, 0021491 and 0063399.

The proportion of the suspended detergent builder, based on the total composition, is usually in the range of from about 10 to 60 weight percent, such as about 20 to 50 weight percent, for example about 25 to 40% by weight of the composition.

According to one embodiment of the invention the physical stability of the suspension of the detergent builder compound or compounds or any other finely divided suspended solid particulate additive, such as bleaching agent, pigment, etc., in the liquid vehicle is drastically improved by the presence of a low density filler such that the density of the continuous liquid phase is approximately the same as the density of the solid particulate dispersed phase including the low density filler.

The low density filler may be any inorganic or organic particulate matter which is insoluble in the liquid phase/solvents used in the composition and is compatible with the various components of the composition. In addition, the filler particles should possess sufficient mechanical strength to sustain the shear stress expected to be encountered during product formulation, packaging, shipping and use.

Within the foregoing general criteria suitable particulate filler materials have effective densities in the range of from about 0.01 to 0.50 g/cc, preferably 0.02 to 0.50 g/cc, especially up to about 0.20 g/cc, particularly, 0.02 to 0.20 g/cc, measured at room temperature, e.g. 23° C., and particle size diameters in the range of from about 1 to 300 microns, preferably 4 or 5 to 200 microns, with average particle size diameters ranging from about 20 to 100 microns, preferably from about 30 to 80 microns.

The types of inorganic and organic fillers which have such low bulk densities are generally hollow microspheres or microballoons or at least highly porous solid particulate matter.

For example, either inorganic or organic microspheres, such as various organic polymeric microspheres or glass bubbles, are preferred. Specific, non-limiting examples of organic polymeric material microspheres include polyvinylidene chloride, polystyrene, polyethylene, polypropylene, polyethylene terephthalate, polyurethanes, polycarbonates, polyamides and the like. More generally, any of the low density particulate filler materials disclosed in the aforementioned GB No. 2,168,377A at page 4, lines 43–55, including those referred to in the Moorehouse, et al. and Wolinski, et al. patents can be used in the non-aqueous compositions of this invention. In addition to hollow microspheres other low density inorganic filler materials may also be used, for example aluminosilicate zeolites, spray-dried clays, etc.

However, in accordance with an especially preferred embodiment of the invention the light weight filler is formed from a water-soluble material. This has the advantage that when used to wash soiled fabrics in an aqueous wash bath the water-soluble particles will dissolve and, therefore, will not deposit on the fabric being washed. In contrast the water-insoluble filler particles can more easily adhere to or be adsorbed on or to the fibers or surface of the laundered fabric.

As a specific example of such light weight filler which is insoluble in the non-aqueous liquid phase of the invention composition but which is soluble in water mention can be made of sodium borosilicate glass, such as the hollow microspheres available under the tradename Q-Cell, particularly Q-Cell 400, Q-Cell 200, Q-Cell 500 and so on. These materials have the additional advantage of providing silicate ions in the wash bath which function as anticorrosion agents.

As examples of water soluble organic material suitable for production of hollow microsphere low density particles mention can be made, for example, of starch, hydroxyethylcellulose, polyvinyl alcohol and polyvinylpyrrolidone, the latter also providing functional properties such as soil suspending agent when dissolved in the aqueous wash bath.

The amount of the low density filler added to the non-aqueous liquid suspension is such that the mean (average) statistically weighted densities of the suspended particles and the low density filler is the same as or not greatly different than the density of the liquid phase (inclusive of nonionic surfactant and other solvents, liquids and dissolved ingredients). What this means, in practical terms, is that the density of the entire composition, after addition of the low density filler, is approximately the same, or the same as the density of the liquid phase alone, and also the density of the dispersed phase alone.

Therefore, the amount to be added of the low density filler will depend on the density of the filler, the density of the liquid phase alone and the density of the total composition excluding the low density filler. For any particular starting liquid dispersion the amount required of the low density filler will increase as the density of the filler increases and conversely, a smaller amount of the low density filler will be required to effect a given reduction in density of the final composition as density of the filler decreases.

The amount of low density filler required to equalize the densities of the liquid phase (known) and the dispersed phase can be theoretically calculated using the following equation which is based on the assumption of ideal mixing of the low density filler and non-aqueous dispersion:

$$\frac{Mms}{Mf} = \frac{d_{ms}}{d_{liq}} \; \frac{d_o - d_{liq}}{d_o - d_{ms}}$$

where

Mms/Mf represents the mass fraction of low density filler (e.g. microspheres) to be added to the suspension to make the final composition density equal to the liquid density;

dms = liquid displacement density of the low density filler;

dliq = density of liquid phase of suspension;

do = density of starting composition (i.e. suspension before addition of filler);

Mf = mass of final composition (i.e. after addition of filler); and

Mms = mass of filler to be added.

Generally, the amount of low density filler required to equalize dispersed phase density and liquid phase density will be within the range of from about 0.01 to 10% by weight, preferably about 0.05 to 6.0% by weight, based on the weight of the non-aqueous dispersion before the addition of the filler. Although it is preferred to make the liquid phase density and dispersed phase density equal to each other, i.e. $d_{liq}/d_{sf}=1.0$, to obtain the highest degree of stability, small differences in the densities, for example $d_{liq}/d_{sf}=0.90$ to 1.10, especially 0.95 to 1.05, (where $d_{sf}$ is the final density of the dispersed phase after addition of the filler) will still give acceptable stabilities in most cases, generally manifested by absence of phase separation, e.g. no appearance of a clear liquid phase, for at least 3 to 6 months or more.

As just described, the addition to the non-aqueous liquid suspension of finely divided fabric treating solid particles, of an amount of low density filler sufficient to provide a mean statistically weighted density of the solid particles and filler particles which is similar to the density of the continuous liquid phase functions to stabilize the suspension against phase separation. However, merely having a statistically weighted average density of the dispersed phase similar to the density of the liquid phase would not appear by itself to explain how or why the low density filler exerts its stabilizing influence, since the final composition still includes the relatively dense dispersed fabric treating solid particles, e.g. phosphates, which should normally settle and the low density filler which should normally rise in the liquid phase.

Although not wishing to be bound by any particular theory, it is presumed, and experimental data and microscopic observations appear to confirm, that the dispersed detergent additive solid particles, such as builder, bleach, and so on, actually are attracted to and adhere and form a mono- or poly-layer of dispersed particles surrounding the particles of low density filler, forming "composite" particles which, in effect, function as single unitary particles. These composite particles can then be considered to have a density which closely approximates a volume weighted average of the densities of all the individual particles forming the composite particles:

$$d_{cp} = \frac{d_H + \frac{V_L}{V_H} d_L}{1 + \frac{V_L}{V_H}}$$

where $d_{cp}$=density of composite particle;

$d_H$=density of dispersed phase (heavy particle);

$d_L$=density of filler (light particle);

$V_H$=total volume of dispersed phase particles in composite;

$V_L$=total volume filler particle in composite.

However, in order for the density of the composite particle to be similar to that of the liquid phase, it is necessary that a large number of dispersed particles interact with each of the filler particles, for example, depending on relative densities, several hundred to several thousand of the dispersed (heavy) particles should associate with each low density filler particle.

Accordingly, to obtain the full advantages of this invention the average particle size diameter of the low density filler must be greater than the average particle size diameter of the dispersed phase particles, such as detergent builder, etc., in order to accommodate the large number of dispersed particles on the surface of the filler particle. In this regard, it has been found that the ratio of the average particle size diameter of the low density filler particle to the average particle size diameter of the dispersed particles must be at least 6:1, such as from 6:1 to 30:1, especially 8:1 to 20:1, with best results being achieved at a ratio of about 10:1. At diameter ratios smaller than 6:1, although some improvement in stabilization may occur, depending on the relative densities of the dispersed particles and filler particles and the density of the liquid phase, satisfactory results will not generally be obtained.

Therefore, for the preferred range of average particle size diameter for the low-density filler particles of 20 to 100 microns, especially 30 to 80 microns, the dispersed phase particles should have average particle size diameters of from about 1 to 18 microns, especially 2 to 10 microns. These particle sizes can be obtained by suitable grinding as described below.

While the incorporation of the low density filler greatly reduces any tendency of the suspended or dispersed phase to settle or rise or for a clear liquid layer to form at the upper portion of the composition, the low density filler also functions to increase the "plastic viscosity" ($\eta_\infty$) of the suspension. While such increase in viscosity is not necessarily disadvantageous, nevertheless, in many circumstances, consumer perception and preference requires that the product be made more readily flowable, namely that plastic viscosity be lowered. However, such lowering of the plastic viscosity should not be accomplished at the expense of reducing the yield value of the non-aqueous suspension, since otherwise the physical stability would be adversely impacted.

According to the present invention the reduction of plastic viscosity without substantially lowering yield value is achieved by the incorporation of the lecithin or other phosphate ester additive as described above. For example, in the absence of the viscosity-lowering additive, the non-aqueous suspensions containing low density filler have plastic viscosities in the range of from about 500 to 5000 mPa.s (1 mPa.s=1 centipoise). With the addition of lecithin or other phosphate ester the viscosity can be lowered as much as 50% or more, for example from about 200 to 3000 mPa.s, preferably 250 to 1000 mPa.s, especially preferably 300 to 600 mPa.s. The exact amount of the additive needed to lower the plastic viscosity to a particular value cannot be precisely defined, but will be dependent on such factors as the initial plastic viscosity, the particular additive, and the specific ingredients of the non-aqueous suspension. Generally, amounts of the viscosity reducing additive of from about 0.1 to 3% by weight, preferably from about 0.3 to 2% by weight, especially from 0.5 to 1.5% by weight, based on the total composition will provide the desired results.

The incorporation into the non-aqueous suspension of finely divided fabric treating particles suspended in nonionic liquid surfactant of organophilic clay, as disclosed in copending application Ser. No. 063,199 provides a viscoelastic network which also improves the physical stability of the non-aqueous suspension. The incorporation of lecithin or other phosphate ester compound defined above in the amounts described provides further improvement in the physical stability of the non-aqueous suspension.

In the preferred embodiment of the invention, the nonaqueous suspension of fabric treating additive includes both the low density filler and organophilic clay. In this preferred embodiment the incorporation of lecithin or other phosphate ester compound additive within the amounts described above lowers plastic viscosity and helps to maintain the viscoelastic network structure imparted by the organophilic clay.

Regarding this preferred embodiment, it was discovered that under transportation (shipping) conditions wherein the low density filler-containing compositions are subjected to the strong and repeated vibrational forces normally encountered in, for example, travel by rail or truck, the low density filler tends to rise to the top of the composition with a corresponding degree of settling of the functionally active solid suspended particles towards the bottom of the vessel in which the composition is stored.

While the reason for the adverse effect of the strong vibrational forces has not been fully determined it may be hypothesized that the vibrational forces are sufficiently strong to overcome the weak attraction between the low density filler and the functionally active suspended particles in the composite particles as previously described. As an alternative theory, it is possible that the strong vibrational forces can result in localized disturbances where yield stress is greater than the yield value of the suspension, thereby causing destabilization.

However, by whatever mechanism the low density filler migrates towards the upper surface of the liquid suspension the homogeneity of the liquid suspension composition can be maintained, even under application of strong vibrational forces, by incorporating into the composition, before, during, or after introduction of the low density filler, of a small amount, generally up to about 1% by weight of the composition of an organophilic modified clay.

The useful organophilic modified clays form a viscoelastic network structure in the composition and it is presumed, although applicants do not wish to be bound by any particular theory of operation, that this elastic network structure is capable of absorbing the strong vibrational forces to thereby stabilize the suspensions even under these adverse conditions, more particularly, it is presumed that the organophilic clay additive increases the yield point of the suspension so that the yield stress resulting from the vibration does not exceed the yield point.

Any of the swelling organophilic modified clays with high gelling efficiency as disclosed in the copending applications Ser. No. 063,199, filed June 17, 1987 and Ser. No. 073,551, filed July 15, 1987 can be used in the present compositions.

The organophilic modified clay can be based on any swelling clay modified to exhibit high gelling efficiency in the organic liquid vehicle. As examples of such swelling clay materials which can be used (after appropriate modification as described below) mention can be made of the smectite clays especially the bentonite, e.g. sodium and lithium bentonites; montmorillonites, e.g. sodium and calcium montmorillonites; saponites, e.g. sodium saponites; and hectorites, e.g. sodium hectorites. Other representative clays include beidellite and stevensite. Hectorite clays, in particular, having outstanding swelling ability are preferred.

The aforementioned smectite-type clays are three-layer clays characterized by the ability of the layered structure to increase its volume several-fold by swelling or expanding when in the presence of water to form a thixotropic gelatinous substance. There are two main classes of smectite-type clays: in the first class, aluminum oxide is present in the silicate crystal lattice; in the second class, magnesium oxide is present in the silicate crystal lattice. Atom substitution by iron, magnesium, sodium, potassium, calcium and the like can occur within the crystal lattice of the smectite clays. It is customary to distinguish between clays on the basis of their predominant cation. For example, a sodium clay is one in which the cation is predominantly sodium. Aluminum silicates wherein sodium is the predominant cation are preferred, such as, for example, bentonite clays. Among the bentonite clays, those from Wyoming (generally referred to as western or Wyoming bentonite) are especially preferred.

Preferred swelling bentonite clays are sold under the trademark Mineral Colloid, as industrial bentonite, by Benton Clay Company, an affiliate of Georgia Kaolin Co. These materials which are same as those formerly sold under the trademark THIXOJEL, are selectively mined and beneficiated bentonite, and those considered to be most useful are available as Mineral Colloid Nos. 101, etc. corresponding to THIXO-JELs Nos. 2, 3 and 4. Such materials have pH's (6% concentration in water) in the range of 8 to 9.4, maximum free moisture contents of about 8% and specific gravities of about 2.6, and for the pulverized grade at least about 85% (and preferably 100%) passes through a 200 mesh U.S. Sieve Series sieve. More preferably, the bentonite is one wherein essentially all the particles (i.e., at lest 90% thereof, preferably over 95%) pass through a No. 325 sieve and most preferably all the particles pass through such a sieve. The swelling capacity of the bentonite in water is usually in the range of 2 to 15 ml/gram, and its viscosity, at a 6% concentration in water, is usually from about 8 to 30 centipoise.

Instead of utilizing the THIXO-JEL or Mineral Colloid bentonite one may employ products, such as that sold by American Colloid Company, Industrial Division, as General Purpose Bentonite Powder, 325 mesh, which has a minimum of 95% thereof finer than 325 mesh or 44 microns in diameter (wet particle size) and a minimum of 96% finer than 200 mesh or 74 microns diameter (dry particle size). Such a hydrous aluminum silicate is comprised principally of montmorillonite (90% minimum), with smaller proportions of feldspar, biotite and selenite. A typical analysis on an "anhydrous" basis, is 63.0% silica, 21.5% alumina, 3.3% of ferric iron (as $Fe_2O_3$), 0.4% of ferrous iron (as FeO), 2.7% of magnesium (as Mg)), 2.6% of sodium and potassium (as $Na_2O$), 0.7% of calcium (as CaO), 5.6% of crystal water (as $H_2O$) and 0.7% of trace elements.

Although the western bentonites are preferred it is also possible to utilize other bentonites, such as those which may be made by treating Italian or similar bentonites containing relatively small proportions of exchangeable monovalent metals (sodium and potassium) with alkaline materials, such as sodium carbonate, to increase the cation exchange capacities of such products. It is considered that the $Na_2O$ content of the bentonite should be at least about 0.5%, preferably at least 1% and more preferably at least 2% so that the clay will be satisfactorily swelling. Preferred swelling bentonites of the types described above are sold under the trade names Laviosa and Winkelmann, e.g. Laviosa AGB and Winkelmann G-13. Other examples include Veegum F and Laponite SP, both sodium hectorites, Gelwhite L, a calcium montmorillonite, Gelwhite GP, a sodium montmorillonite, Barasym LIH 200, a lithium hectorite.

The smectite clay materials as described above are hydrophilic in nature, i.e. they display swelling characteristics in aqueous media. Conversely, they are organophobic in nature and do not swell in non-aqueous or predominantly non-aqueous systems.

Therefore, the organophobic nature of the smectite clay materials is converted to an organophilic nature. This can be accomplished by exchanging the metal cation, e.g., Na, K, Li, Ca, etc. of the clay, with an organic cation, at least on the surface of the clay particles, for example, by admixing the clay, organic cation and water, together, preferably at a temperature within the range of 20° to 100° C., for a period of time sufficient for the organic cation to intercalate with the clay particles at least on the surface, followed by filtering, washing, drying and grinding. For further details reference can be made to any of the aforementioned U.S. Pat. Nos. 2,531,427, 2,966,506, 4,105,578, 4,208,218, 4,287,086, 4,424,075 and 4,434,076, the disclosures of which are incorporated herein in their entireties by reference thereto.

The organic cationic material is preferably a quaternary ammonium compound, particularly one having surfactant properties, indicative of at least one long chain hydrocarbon group (e.g. from about 8 to about 22 carbon atoms), although surfactant properties or other fabric beneficial properties are not required, nor is it essential that the cationic modifier itself be useful as a suspension agent. However, any of the cationic surfactant compounds disclosed as useful auxiliary suspension aids in the aforementioned U.S. Pat. No. 4,264,466, at columns 23–29, the disclosure of which is incorporated herein in its entirety, can be used for modifying the smectite clay material to render the latter organophilic. The organic cationic nitrogen compounds described in the aforementioned patent 2,531,427 to Hauser, or those mentioned in any of the NL Industries patents 2,966,506; 4,105,578, and so on, the disclosures of which are incorporated herein by reference, can also be favorably used.

The preferred modifiers are the quaternary ammonium compounds of formula $$[R_1R_2R_3R_4N]^+X^-$$

wherein $R^1$, $R_2$, $R_3$ and $R_4$, are each, independently, hydrogen, or a hydrophobic organic alkyl, aryl, aralkyl, alkaryl or alkenyl radical containing from 1 to 30 carbon atoms, preferably 1 to 22 carbon atoms, at least two R groups preferably having from 1 to 6 carbon atoms and at least one R group, preferably at most two R groups, having from 8 to 22 carbon atoms; X is an anion, which may be inorganic, such as halide, e.g. chloride or bromide, sulfate, phosphate, hydroxide, or nitrate, or organic, such as methylsulfate, ethylsulfate, or fatty acid, e.g. acetate, propionate, laurate, myristate, palmitate, oleate or stearate.

Examples of preferred organophilic modifiers are the mono-and di-long chain (e.g. $C_8$ to $C_{18}$, especially $C_{10}$ to $C_{18}$) alkyl quaternary compounds. Representative examples of the mono-long chain quaternary ammonium surfactants include stearyl trimethyl ammonium chloride, tallow trimethyl ammonium chloride, benzyl stearyl dimethyl ammonium chloride, benzyl hydrogenated tallow dimethyl ammonium chloride, benzyl cetyl dimethyl ammonium chloride and the corresponding bromides, iodides, sulfates, methosulfates, acetates, and other anions previously mentioned. Typical representative examples of the di-long chain quaternary ammonium compounds include dimethyl distearyl ammonium chloride, dimethyl dicetyl ammonium chloride, dimethyl stearyl cetyl ammonium chloride, dimethyl ditallow ammonium chloride, dimethyl myristyl cetyl ammonium chloride, and the corresponding bromides, iodides, sulfates, methosulfates, acetates and other anions previously mentioned. Other representative compounds include octadecyl ammonium chloride, hexadecyl ammonium acatete, and so on. Dimethyl alkylaryl ammonium salts are the most preferred of the QA compounds in view of their high polarity.

In addition to the quaternary ammonium (QA) compounds, other quaternizable nitrogen containing organic cations can also be used to form organophilic clay particles. For instance mention can be made of imidazolinium compounds such as, for example, 1-(2-hydroxyethyl)-2-dodecyl-1-benzyl-2 imidazolinium chloride, and heterocyclic nitrogen ring containing compounds, such as long chain hydrocarbon substituted pyrrolidones, pyridenes, morpholines, and the like, such as N,N-octadecylmorpholinium chloride.

The amount of organic cation substitution need only be that amount sufficient to impart to the clay the requisite organophilic property to provide the enhanced stabilizing characteristic desired. Generally, depending on the nature of the organic substituent this amount can range from about 10 to 100%, preferably 20 to 100%, such as 30%, 40%, 50% or 60%, of the available base exchange capacity of the clay material. Usually, and preferably, at least sufficient of the organic compound is used to cover or coat the surface of the clay particles.

Suitable organophilic clays which can be used in this invention are commercially available, for example, the products sold under the Bentone trademark of NL Industries, New York, New York, such as Bentone 27, which is a hectorite clay (magnesium montmorrilonite) modified with benzyl dimethyl hydrogenated tallow ammonium chloride, and Bentone 38, which is a hectorite clay, modified with dimethyl dioctadecyl ammonium chloride. Other sources of organophilic clays include, for example, Sud-Chemie, Munich Germany; Laviosa, Livorno, Italy; Laporte, France; and Perchem, United Kingdom.

The organophilic clays are used in only minor amount, generally less than 1.0% by weight, preferably less than 0.7% by weight, based on the total composition. Usually, amounts of at least about 0.1 weight percent, preferably 0.2 weight percent, such as 0.25%, 0.3%, 0.35% or 0.4%, will enable production of stable, mildly thixotropic non-aqueous liquid suspensions of finely divided detergent builder or other water soluble or dispersible fabric treating agent.

The organophilic modified clay can be incorporated into the non-aqueous liquid dispersion of the suspended particulate ingredients either directly as a powder or after first being predispersed in a portion of the liquid vehicle of the suspension, e.g., the liquid nonionic surfactant, the latter method being preferred. Furthermore, whether added to the suspension directly as a powder or pre-gelled in a portion of the liquid vehicle, the organophilic clay may be added to the suspension before or after the suspension is ground to an average particle size of no more than 15 microns, preferably no more than 10, especially from 1 to 10 microns, most preferably from 4 to 8 microns.

In a preferred embodiment the organophilic clay is first predispersed either in part of the liquid nonionic surfactant forming the principal liquid vehicle or in a different nonionic surfactant or in a solvent or diluent as previously described, or in any suitable mixture of surfactant(s), and/or solvent(s), and/or diluent(s). The predispersed clay suspension, if necessary, can be subjected to grinding in a high shear grinder, to form an organophilic clay pregel. Separately, the remaining solid particulate matter is suspended in the liquid nonionic surfactant and optional diluent/solvent, and is also subjected to grinding. The clay pregel and the particulate matter suspension can be ground to the final desired average particle size before they are mixed with each other, or the pregel and suspension can be mixed and then subjected to further grinding. In the latter case, the suspended particulate matter can further contribute to the attrition of the organophilic clay particles.

It is an additional advantage of this preferred embodiment of this invention where the organophilic clay is subjected to a grinding step that the incorporation of the lecithin or other phosphate ester will reduce the viscosity of the predispersed clay suspension, with or without other solid particulate matter. Accordingly, the grinding step is greatly facilitated and the use of processing aids or a heating step does not become necessary.

In any of the foregoing embodiments wherein the organophilic clay is subjected to grinding, such as to form an organophilic clay gel, the clay is added separately from the low density filler since the latter should not be subjected to high shear or grinding forces. Moreover, it is preferred that the low density filler is added as the last component of the formulation under conditions which minimize the shear forces applied to the low density filler while still providing uniform distribution of the filler throughout the composition. To accomplish this result it has been found convenient to mix all of the ingredients, including the organophilic clay, where used as previously described, except for the low density filler, and to form a thickened suspension and thereafter subject the suspension to mixing under low shear with a propeller-type blade mixer, rotated at between 50 and 500 r.p.m. such as to generate a cavity (vortex) at the center of the mixing vessel, and thereafter, the low density filler is added near the top of the vortex to cause the filler to be uniformly dispersed throughout the composition.

In addition to its primary benefits as a viscosity reducing agent and rheological stabilizer, the use of lecithin, in particular, confers several additional benefits. For example, lecithin, due to its amphoteric nature, can interact with the nonionic surfactant forming the liquid phase to boost the detergency of the nonionic. Lecithin, having two fatty acid radicals and a quaternary ammonium group, also can impart softening benefits to fabrics treated therewith. Lecithin can also serve as a heavy metal sequestering agent and can therefore serve the role of a bleach stabilizer. These additional benefits can make lecithin and the other phosphate ester compounds useful additives in non-aqueous suspensions of functionally active laundry additive solid particles even where neither of the low density filler and organophilic clay additives are present.

Since the compositions of this invention are generally highly concentrated, and, therefore, may be used at relatively low dosages, it is often desirable to supplement any phosphate builder (such as sodium tripolyphosphate) with an auxiliary builder such as a polymeric carboxylic acid having high calcium binding capacity to inhibit incrustation which could otherwise be caused by formation of an insoluble calcium phosphate. Such auxiliary builders are also well known in the art. For example, mention can be made of Sokolan CP5 which is a copolymer of about equal moles of methacrylic acid and maleic anhydride, completely neutralized to form the sodium salt thereof. The amount of the auxiliary builder is generally up to about 6 weight percent, preferably ¼ to 4%, such as 1%, 2% or 3%, based on the total weight of the composition. Of course, the present compositions, where required by environmental constraints, can be prepared without any phosphate builder.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose, usually in amounts of up to 10 weight percent, for example 0.1 to 10%, preferably 1 to 5%; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidine sulfone, etc., most preferred are stilbene and triazole combinations. Typically, amount of the optical brightener up to about 2 weight percent, preferably up to 1 weight percent, such as 0.1 to 0.8 weight percent, can be used.

Bluing agents such as ultramarine blue; enzymes, preferably proteolytic enzymes, such as subtilisin, bromelin, papain, trypain and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and anti-foam agents or suds-suppressor, e.g. silicon compounds can also be used.

The bleaching agents are classified broadly for convenience, as chlorine bleaches and oxygen bleaches. Chlorine bleaches are typified by sodium hypochlorite (NaOCl), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Preferred sequestering agents are able to form a complex with $Cu2+$ ions, such that the stability constant (pK) of the complexation is equal to or greater than 6, at 25° C., in water, of an ionic strength of 0.1 mole/liter, pK being conventionally defined by the formula: $pK = -\log K$ where K represents the equilibrium constant. Thus, for example, the pK values for complexation of copper ion with NTA and EDTA at the stated conditions are 12.7 and 18.8, respectively. Suitable sequestering agents include, for example, in addition to those mentioned above, the compounds sold under the Dequest trademark, such as, for example, diethylene triamine pentaacetic acid (DETPA); diethylene triamine pentamethylene phosphonic acid (DTPMP); and ethylene diamine tetramethylene phosphonic acid (EDITEMPA).

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred non-aqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

Although not required to achieve acceptable product stability, it is also within the scope of this invention to include other suspension stabilizers, rheological additives, and antigelling agents. For example, the aluminum salts of higher fatty acids, especially aluminum stearate, as disclosed in U.S. Pat. No. 4,661,280, the disclosure of which is incorporated herein by reference, can be added to the composition, for example, in amount of 0 to 3% by weight, preferably 0 to 1% by weight.

Another potentially useful stabilizer for use in conjunction with the low density filler, is an acidic organic phosphorus compound having an acidic-POH group, as disclosed in the commonly assigned copending application Ser. No. 781,189, filed Sept. 25, 1985, to Broze, et al., the disclosure of which is incorporated herein by reference thereto. The acidic organic phosphorus compound, may be, for instance, a partial ester of phosphoric acid and an alcohol, such as an alkanol having a lipophilic character, having, for instance, more than 5 carbon atoms, e.g. 8 to 20 carbon atoms. A specific example is a partial ester of phosphoric acid and a $C_{16}$ to $C_{18}$ alkanol. Empiphos 5632 from Marchon is made up of about 35% monoester and 65% diester. When used amounts of the phosphoric acid compound up to about 3%, preferably up to 1%, are sufficient.

As disclosed in copending application Ser. No. 926,851, filed Nov. 3, 1986, to Broze, et al., the disclosure of which is incorporated herein by reference, a nonionic surfactant which has been modified to convert a free hydroxyl group to a moiety having a free carboxyl group, such as a partial ester of a nonionic surfactant and a polycarboxylic acid, can be incorporated into the composition to further improve rheological properties. For instance, amounts of the acid-terminated nonionic surfactant of up to 1 per part of the nonionic surfactant, such as 0.1 to 0.8 part, are sufficient.

Suitable ranges of these optional detergent additives are: enzymes—0 to 2%, especially 0.1 to 1.3%; corrosion inhibitors—about 0 to 40%, and preferably 5 to 30%; anti-foam agents and suds-suppressor—0 to 15%, preferably 0 to 5%, for example 0.1 to 3%; thickening agent and dispersants—0 to 15%, for example 0.1 to 10%, preferably 1 to 5%; soil suspending or anti-redeposition agents and anti-yellowing agents—0 to 10%, preferably 0.5 to 5%; colorants, perfumes, brighteners and bluing agents total weight 0% to about 2% and preferably 0% to about 1%; pH modifiers and pH buffers—0 to 5%, preferably 0 to 2%; bleaching agent—0% to about 40% and preferably 0% to about 25%, for example 2 to 20%; bleach stabilizers and bleach activators 0 to about 15%, preferably 0 to 10%, for example, 0.1 to 8%; enzyme-inhibitors 0 to 15%, for example, 0.01 to 15%, preferably 0.1 to 10%; sequestering agent of high complexing power, in the range of up to about 5%, preferably ¼ to 3%, such as about ½ to 2%. In the selections of the adjuvants, they will be chosen to be compatible with the main constituents of the detergent composition.

In a preferred form of the invention, as described above, the mixture of liquid nonionic surfactant and solid ingredients (other than low density filler) is subjected to grinding, for example, by a sand mill or ball mill. Especially useful are the attrition types of mill, such as those sold by Wiener-Amsterdam or Netzsch-Germany, for example, in which the particle sizes of the solid ingredients are reduced to less than about 18 microns, e.g. to an average particle size of 2 to 10 microns or even lower (e.g. 1 micron). Preferably less than about 10%, especially less than about 5 of all the suspended particles have particle sizes greater than 15 microns, preferably 10 microns. In view of increasing costs in energy consumption as particle size decreases it is often preferred that the average particle size be at least 3 microns, especially about 4 microns. Compositions whose dispersed particles are of such small size have improved stability against separation or settling on storage. Other types of grinding mills, such as toothmill, peg mill and the like, may also be used.

In the grinding operation, it is preferred that the proportion of solid ingredients be high enough (e.g. at least about 40%, such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 18 or 15 microns in the continuous ball mill.

Alternatively, the powdery solid particles may be finely ground to the desired size before blending with the liquid matrix, for instance, in a jet-mill.

The final compositions of this invention are nonaqueous liquid suspensions, generally exhibiting non-Newtonian flow characteristics. The compositions, after addition of the low density filler, are often slightly thixotropic, namely exhibit reduced viscosity under applied stress or shear, and behave, rheologically, substantially according to the Casson equation. The final compositions are characterized by a yield value between about 2.5 and 45 pascals, more usually between 10 and 35 pascals, such as 15, 20 or 25 pascals. Furthermore, the compositions after addition of lecithin or phosphate ester compound have viscosities at room temperature measured using an LVT-D viscometer, with No. 4 spindle, at 50 r.p.m., ranging from about 200 to 3,000 centipoise, usually from about 250 to 1,000 centipoise, and is readily flowable, generally not requiring application of stress or shaking. Thus, the compositions of this invention may conveniently be packaged in ordinary vessels, such as glass or plastic, rigid or flexible bottles, jars or other container, and dispensed therefrom directly into the aqueous wash bath, such as in an automatic washing machine, in usual amounts, such as ¼ to 1½ cups, for example, ½ cup, per laundry load (of approximately 3 to 15 pounds, for example), for each load of laundry, usually in 8 to 18 gallons of water. The preferred compositions will remain stable (usually none, but no more than 1 or 2 mm liquid phase separation) when left to stand for periods of 3 to 6 months or longer, even subjected to shaking.

It is understood that the foregoing detailed description is given merely by way of illustration and that variations may be made therein without departing from the spirit of the invention.

It should also be understood that as used in the specification and in the appended claims the term "non-aqueous" means absence of water, however, small amounts of water, for example up to about 5%, preferably up to about 2%, may be tolerated in the compositions and, therefore, "non-aqueous" compositions can include such small amounts of water, whether added directly or as a carrier or solvent for one of the other ingredients in the composition.

The liquid fabric treating compositions of this invention may be packaged in conventional glass or plastic vessels and also in single use packages, such as the doserettes and disposable sachet dispensers disclosed in the commonly assigned, copending application Ser. No. 063,199, filed June 17, 1987, the disclosure of which is incorporated herein by reference thereto.

The invention will now be described by way of the following non-limiting example in which all proportions and percentages are by weight, unless otherwise indicated. Also, atmospheric pressure is used unless otherwise indicated.

EXAMPLE 1

A non-aqueous built liquid detergent composition according to the invention is prepared by mixing and finely grinding to about 4 microns the following ingredients, except for the Q-Cell filler, in the following approximate amounts and thereafter adding to the resulting dispersion, with stirring, the Q-Cell filler. To add the light weight filler, the ground dispersion is mixed under low shear with a propeller type blade mixer, rotating about 150 r.p.m. to generate a cavity (vortex) at the center of the mixing vessel and the Q-Cell filler particles are added near the top of the vortex to cause the filler particles to be uniformly dispersed throughout the composition while minimizing shear forces that could cause the hollow microspheres to rupture. Composition I is thereby obtained. A control composition II is obtained by the same procedure described above except that the lecithin is omitted. A second control composition II-1 is prepared in the same manner as control composition II except that the Bentone 27 is post-added to the remaining ingredients in the same mixing vessel as the Q-cell filler particles. Control composition III is prepared in the same manner as composition I except that the Q-cell 400 and lecithin are omitted.

| | Amount Weight % | |
|---|---|---|
| | I | II (control) |
| Nonionic surfactant 1 | 36.45 | 36.3 |
| Diethylene glycol monobutyl ether | 8.8 | 9.8 |
| Sodium Tripolyphosphate (hydrated) | 28.70 | 29.1 |
| Sokalan HC 9786 2 | 2.0 | 1.9 |
| Bentone 27 3 | 0.3 | 0.3 |
| Sodium perborate monohydrate | 10.5 | 10.6 |
| Tetraacetylethylenediamine | 4.5 | 4.3 |
| Carboxymethyl cellulose | 1.0 | 1.0 |
| DEQUEST 4066 4 | 1.0 | 1.0 |
| Enzyme (mixed proteolytic and amylase) | 0.55 | 0.5 |
| Q-Cell 400 5 | 4.0 | 4.0 |
| Perfume | 0.5 | 0.5 |
| $TiO_2$ (Rutile) | 0.4 | 0.4 |
| Optical Brightener | 0.3 | 0.3 |
| Lecithin, soya bean | 1.0 | — |
| | 100.00 | 100.00 |
| Viscosity (centipoise) | 400 | 800 |

1 Purchased from BASF, mixed propylene oxide (4 moles) - ethylene oxide (7 moles) condensate of a fatty alcohol having from 13 to 15 carbon atoms
2 Copolymer of methacrylic acid and maleic anhydride
3 Hectorite clay, modified with dimethyl benzyl hydrogenated tallow ammonium chloride 35% cation exchanged, from NL Industries
4 Diethylene triamine pentamethylene phosphonic acid
5 Sodium borosilicate hollow glass microspheres - particle size range 10–200 microns, average particle size 75 microns, effective density 0.16–0.18 g/cc.

The compositions I, II and II-1 are stored overnight in clear plastic container. At the end of the first day and after ageing for 7 days, 15 days, 30 days and 60 days the yield value and plastic viscosity of each composition are measured. The results are shown in Table I and Table II, respectively.

TABLE I

| YIELD VALUE (PASCALS) WITH AGEING | | | | | |
|---|---|---|---|---|---|
| | AGEING TIME (DAYS) | | | | |
| Composition | 1 | 7 | 15 | 30 | 60 |
| I | 11.3 | 12.2 | 12.2 | 12.7 | — |
| II | 8.9 | 7.8 | 7.0 | 5.4 | 4.2 |
| II-1 | 10.8 | 9.4 | 7.6 | 6.2 | — |

TABLE II

| PLASTIC VISCOSITY (mPa.S) WITH AGING | | | | | |
|---|---|---|---|---|---|
| | AGING TIME (DAYS) | | | | |
| Composition | 1 | 7 | 15 | 30 | 60 |
| I | 390 | 400 | 400 | 420 | — |

TABLE II-continued

| PLASTIC VISCOSITY (mPa.S) WITH AGING | | | | | |
|---|---|---|---|---|---|
| | AGING TIME (DAYS) | | | | |
| Composition | 1 | 7 | 15 | 30 | 60 |
| II | 750 | 800 | 800 | 830 | 870 |
| II-1 | 600 | 600 | 650 | 700 | — |
| III | 200 | 230 | 250 | 270 | 270 |

From the above results it can be appreciated that incorporation of 1% lecithin in the low density filler-/organophilic clay stabilized non-aqueous suspension strongly stabilizes the aged composition by maintaining, and even slightly increasing, its yield value, and lowers the plastic viscosity by about 50%.

Although not wishing to be bound to any particular theory of operation it is presumed that the lecithin functions to strongly stabilize the yield value of the composition by strengthening the hydrogen bonding between Bentone (the organophilic clay) platelets by virtue of the phosphate group. In addition, the quaternary ammonium group ($-N^+(CH_3)_3$) of the phosphatidyl choline component is apparently substituted on or fixed to the bentone platelets.

Thus, it can be seen that the addition of small amounts of lecithin or structurally similar phosphate ester compounds, especially those compounds in which the phosphate ester includes a terminal quaternary ammonium nitrogen atom bonded through 1 or more, preferably 2 to 6, carbon atoms to the phosphate group, to a non-aqueous suspension containing at least one of low density filler and organophilic clay substantially improves the physical stability of the non-aqueous suspensions, even under severe vibrational forces, while lowering the plastic viscosity such that the suspension is readily flowable.

If the above example is repeated except that in place of 4% Q-Cell 400, 1% Expancel (polyvinylidene chloride microspheres, particle size range 10 to 100 microns, average particle size 40 microns; density 0.03 g/cc) is used, similar results will be obtained. Similarly, replacing the nonionic surfactant with Plurafac RA20, Plurafac D25, Plurafac RA50, or Dobanol 25-7 or Neodol 23-6.5, will provide similar results. If the above example is repeated except that in place of Bentone 27, Bentone 38 (hectorite clay modified with dimethyldioctadecyl ammonium chloride) is used, similar results will be obtained.

If in composition I the amount of lecithin is decreased to 0.3 weight percent, the plastic viscosity increases to 500 cps which is still easily pourable.

What is claimed is:

1. A non-aqueous liquid fabric treating composition which comprises (a) a non-aqueous liquid comprising a nonionic surfactant; (b) functionally active laundry additive solid particles including at least one of detergent builders and bleaching agents suspended in said non-aqueous liquid; at least one of (c) low density filler having a density in the range of from about 0.01 to 0.5 g/cc in an amount of from about 0.01 to 10% by weight of the composition before the addition of said filler and sufficient to substantially equalize the density of the continuous liquid phase and the density of the suspended particle phase, inclusive of the low density filler and the suspended functionally active solid particles, thereby inhibiting settling of the suspended particles while the composition is at rest, and (d) an amount in the range of 0.1 to 1.0% by weight, based on the total composition, of an organophilic clay, to inhibit phase separation when the composition is subjected to strong vibrational forces; and (e) lecithin or an alkylamine-, alkenylamine-, alkylammonium- or alkenylammonium-phosphate ester of glycol, polyglycol or glycerol, having at least one long chain fatty carboxylic acid ester group in the molecule, in an amount sufficient to reduce the viscosity and further stabilize the rheological properties of the composition.

2. The composition of claim I wherein component (e) is lecithin.

3. The composition of claim 1 wherein component (e) is a phosphate ester compound of the formula (I) or (II):

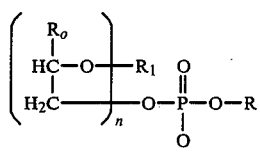

(I)

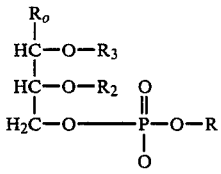

(II)

where

R represents a linear or branched alkyl or alkenyl group having from 1 to 8 carbon atoms and which is substituted by an amino group of formula $-NR_4R_5$, where $R_4$ and $R_5$ are, independently, hydrogen or alkyl of 1 to 4 carbon atoms, or by a quaternized nitrogen of formula $-NR_4R_5R_6$, where $R_4$ and $R_5$ are defined above and $R_6$ is hydrogen or alkyl of 1 to 4 carbon atoms;

$R_0$ is hydrogen or lower alkyl or lower alkenyl;

$R_1$ is an acyl residue of a long chain fatty acid;

$R_2$ is hydrogen or an acyl residue of a long chain fatty acid;

$R_3$ is hydrogen or an acyl residue of a long chain fatty acid;

with the proviso that $R_2$ and $R_3$ are not both hydrogen at the same time; and n is a number of from 1 to 10.

4. The composition of claim 3 wherein component (c) is present.

5. The composition of claim 3 wherein component (d) is present.

6. The composition of claim 3 wherein components (c) and (d) are both present.

7. The composition of claim 1 wherein the amount of component (e) is sufficient to lower the plastic viscosity of the composition to within the range of from about 200 to about 1000 mPa.S.

8. The composition of claim 1 wherein the amount of component (e) is sufficient to lower the plastic viscosity of the composition to within the range of from about 300 to 600 mPa.S.

9. The fabric treating composition of claim 6 wherein the low density filler is comprised of hollow plastic or glass microspheres having a density in the range of from about 0.02 to 0.5 g/cc.

10. The fabric treating composition of claim 9 wherein the low density filler comprises water-soluble borosilicate glass microspheres.

11. The fabric treating composition of claim 6 wherein the organophilic clay comprises a swelling smectite clay modified with a nitrogen containing compound including at least one long chain hydrocarbon having from about 8 to about 22 carbon atoms.

12. The fabric treating composition of claim 7 wherein said nitrogen containing compound is a quaternary ammonium compound.

13. The fabric treating compound of claim 12 wherein the quaternary ammonium compound is a compound of the formula $$[R_1R_2R_3R_4N]^+X^-$$

wherein $R_1$, $R_2$, $R_3$ and $R_4$ are each, independently, hydrogen or an alkyl, alkenyl, aryl, aralkyl or alkaryl group having from 1 to 22 carbon atoms, at least two of $R_1$–$R_4$ having from 1 to about 6 carbon atoms and at most two of $R_1$–$R_4$ having from about 8 to about 22 carbon atoms; and X is an inorganic or organic anion.

14. The composition of claim 1 wherein the non-aqueous liquid comprises from about 30% to about 70% by weight of the composition and the suspended solid particles comprise from about to about 30% by weight of the composition.

15. The composition of claim 14 wherein the nonaqueous liquid comprises from about 40% to 65% by weight of the composition and the suspended solid particles comprise from about 60% to 35% by weight of the composition.

16. The composition of claim 1 comprising from about to about 50% of alkoxylated fatty alcohol nonionic surfactant;

from about 0 to about 20% of alkylene glycol ether viscosity control and antigelling agent;

from about 15 to about 50% of detergent builder particles;

from about 0 to about 50% in total of one or more optional detergent additives selected from the following: enzymes, enzyme inhibitors, corrosion inhibitors, anti-foam agents, suds suppressors, soil suspending agents, anti-yellowing agents, colorants, perfumes, optical brighteners, bluing agents, pH modifiers, pH buffers, bleaching agents, bleach stabilizers, and sequestering agents;

from about 0.01 to about 10% of low density hollow microsphere filler, based on the weight of the composition before addition of the filler;

from about 0.2 to about 0.7% of organophilic modified clay; and from about 0.1 to 3% of lecithin or an alkylamine-, alkenylamine-, alkenylammonium- or alkenylammonium-phosphate ester of glycol, polyglycol or glycerol having at least one long chain fatty carboxylic acid ester group in the molecule.

17. A heavy duty built liquid thickened non-aqueous laundry detergent composition comprising from about 30 to about 40% of a liquid nonionic surfactant which is a mixed ethylene oxide-propylene oxide condensate of a fatty alcohol having from about 12 to about 18 carbon atoms;

from about 25 to about 40% of alkali metal phosphate detergent builder salt;

from about 5 to about 12% of an alkylene glycol ether solvent as a viscosity control and anti-gelling agent;

from about 2 to about 20% of a peroxide bleaching agent;

from about 0.1 to about 8% of a bleach activator;

up to about 2% of enzymes;

up to about 10% of soil suspending, anti-redeposition and anti-yellowing agents;

up to about 5% of high complexing power sequestering agent;

up to about 2% each of one or more of colorants, perfumes and optical brighteners;

the solid components of said composition having an average particle size in the range of from about 2 to 10 microns, with no more than about 10% of the particles having a particle size of more than 10 microns;

from about 0.05 to about 6% of inorganic or organic filler particles having a density of from about 0.01 to 0.50 g/cc and an average size particle diameter of from about 20 to 80 microns;

from about 0.2 to about 0.7% of an organophilic modified smectite clay in which from about 10 to 100% of the available base exchange capacity of the smectite clay is replaced by an organic cationic nitrogen compound having at least one long chain hydrocarbon with from about 8 to about 22 carbon atoms;

said composition, after the addition of said filler particles having a viscosity in the range of from about 500 to 5,000 centipoise; and from about 0.1 to 3% by weight of lecithin, such that the viscosity of the composition is lowered to within the range of from about 200 to 1,000 centipoise.

18. The laundry detergent composition of claim 17 wherein the filler particles are comprised of sodium borosilicate hollow glass microspheres.

19. A method for cleaning soiled fabrics which comprises contacting the soiled fabrics with the laundry fabric treating composition of claim 1 in an aqueous wash bath.

20. The method of claim 18 wherein the contact is in an automatic laundry washing machine.

21. A method for stabilizing against settling of the dispersed finely divided particle phase of a suspension of said solid particles in a non-aqueous liquid phase, said solid particles having densities greater than the density of the liquid phase, said method comprising adding to the suspension of said solid particles an amount of a finely divided filler having a density lower than the density of the liquid phase such that the density of the dispersed solid particles together with said filler becomes similar to the density of the liquid phase, an amount of organophilic modified clay to impart a viscoelastic network structure to the composition to thereby inhibit phase separation of the suspended solid particles or filler particles even when the composition is subjected to severe vibration, and lecithin or an alkylamine-, alkenylamine-, alkylammonium- or alkenylammonium-phosphate ester of a glycol, polyglycol or glycerol having at least one long chain fatty carboxylic acid ester in the molecule to reduce the plastic viscosity of the composition and to stabilize the viscoelastic network structure of the composition.

22. The composition of claim 3 whewrein the ratio of the average particle size diameter of the low density filler to the average particle size diameter of the solid particles is at least 6:1.

23. The composition of claim 16 whewrein the ratio of the average particle size diameter of the low density filler to the average particle size diameter of the solid particles is at least 6:1.

24. The composition of claim 17 wherein the ratio of the average particle size diameter of the low density filler to the average particle size diameter of the solid particles is at least 6:1.

25. A non-aqueous liquid fabric treating composition which comprises (a) a non-aqueous liquid comprising a non-ionic surfactant; (b) functionally active laundry additive solid particles including at least one of detergent builders and bleaching agents suspended in said non-aqueous liquid; (c) from about 0.1 to 10% by weight of the remaining composition of a low density filler having a density in the range of from about 0.1 to 0.5 g/cc, and an average particle size diameter of from about 5 to about 200 microns, said amount being sufficient to substantially equalize the density of the continuous liquid phase and the density of the suspended particle phase inclusive of the low density filler and the suspended functionally active solid particles, thereby inhibiting settling of the suspended particles while the composition is at rest, and (d) from about 0.1 to 1.0% by weight, based on the total composition, of an organophilic modified smectite clay in which from about 10 to 100% of the available base exchange capacity of the smectite clay is replaced by an organic cationic nitrogen compound having at least one long chain hydrocarbon with from about 8 to about 22 carbon atoms, the amount of said organophilic clay being sufficient to inhibit phase separation when the composition is subjected to strong vibrational forces; and (e) from about 0.1 to 3% by weight of lecithin or an alkylamine-, alkenylamine-, alkylammonium- or alkenylammonium-phosphate ester of glycol, polyglycol or glycerol, having at least one long chain fatty carboxylic acid ester group in the molecule, said amount being sufficient to reduce the viscosity and further stabilize the rheological properties of the composition.

* * * * *